US007717308B2

(12) United States Patent
Goldman

(10) Patent No.: US 7,717,308 B2
(45) Date of Patent: May 18, 2010

(54) INDICATOR AND GARMENT HANGER

(75) Inventor: Stuart Goldman, Wayne, NJ (US)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 0 days.

(21) Appl. No.: 12/035,322

(22) Filed: Feb. 21, 2008

(65) Prior Publication Data

US 2009/0212080 A1 Aug. 27, 2009

(51) Int. Cl.
*A41D 27/22* (2006.01)

(52) U.S. Cl. ..... 223/85; 40/322

(58) Field of Classification Search ..... 223/85, 223/88, 92, 95; 40/322; D6/328
See application file for complete search history.

(56) References Cited

U.S. PATENT DOCUMENTS 3,949,914 A * 4/1976 Ostroll ..... 223/85
D282,982 S * 3/1986 Kodet ..... D6/328
4,756,104 A * 7/1988 Bailey ..... 40/322
5,503,310 A * 4/1996 Zuckerman et al. ..... 223/85
5,603,437 A * 2/1997 Zuckerman ..... 223/85
5,775,553 A * 7/1998 Marshall et al. ..... 223/85
5,778,575 A * 7/1998 Deupree et al. ..... 40/322
5,794,363 A * 8/1998 Marshall et al. ..... 40/322
6,705,496 B2 * 3/2004 Marshall et al. ..... 223/85
7,178,705 B1 * 2/2007 Sutton ..... 223/85
D547,557 S * 7/2007 Wu ..... D6/328
7,287,674 B1 * 10/2007 Sutton et al. ..... 223/85
2002/0184799 A1 * 12/2002 Chou ..... 40/322
2006/0213938 A1 * 9/2006 Gouldson ..... 223/85

* cited by examiner

*Primary Examiner*—Gary L Welch
*Assistant Examiner*—Nathan E Durham
(74) *Attorney, Agent, or Firm*—Leason Ellis LLP

(57) ABSTRACT

In one aspect of the present invention, a top sizer is provided for use in combination with a garment hanger having a body and a hook member. The top sizer has a hollow body having an open bottom, a pair of side walls and a convex top wall that extends between the side walls and closes off a top of the top sizer and at least one locking member formed along an inner surface of one side wall.

8 Claims, 3 Drawing Sheets

Fig. 1
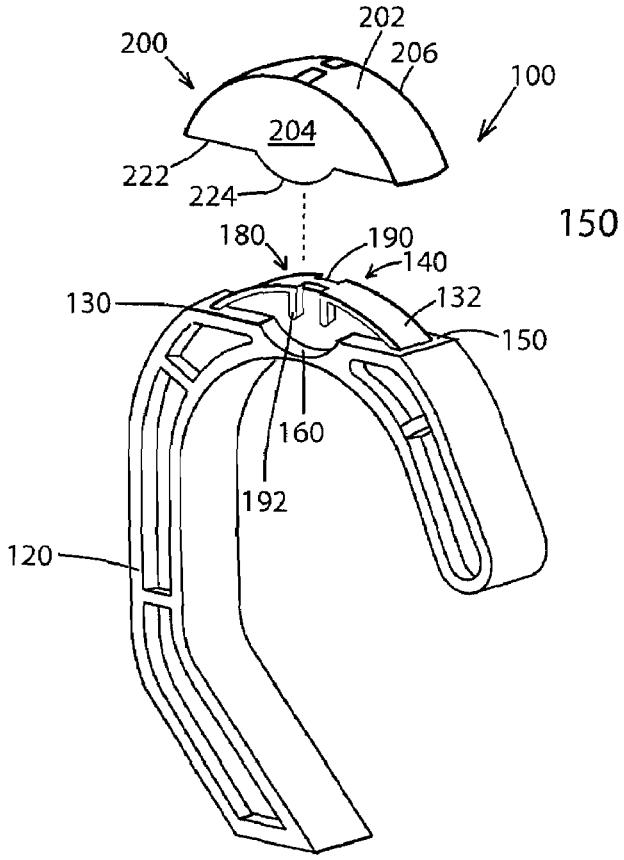
Fig. 2
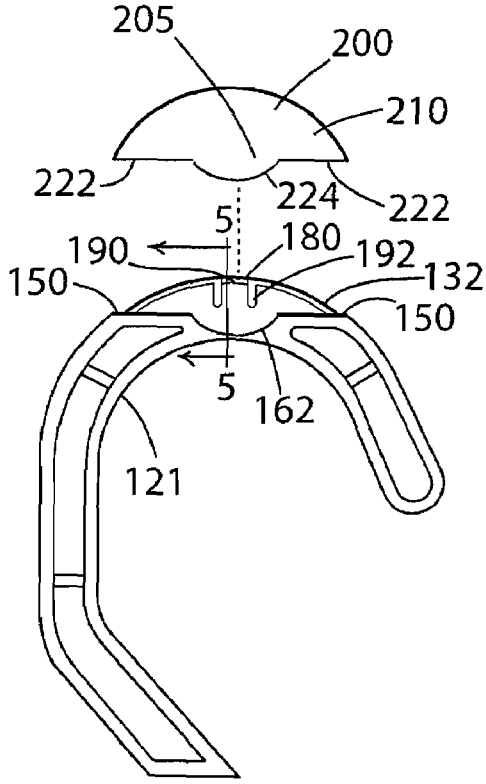
Fig. 3
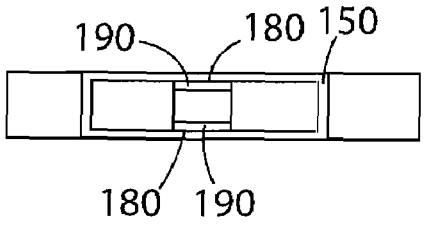
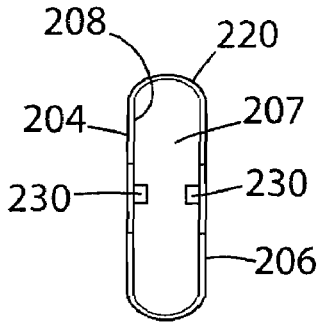
Fig. 4

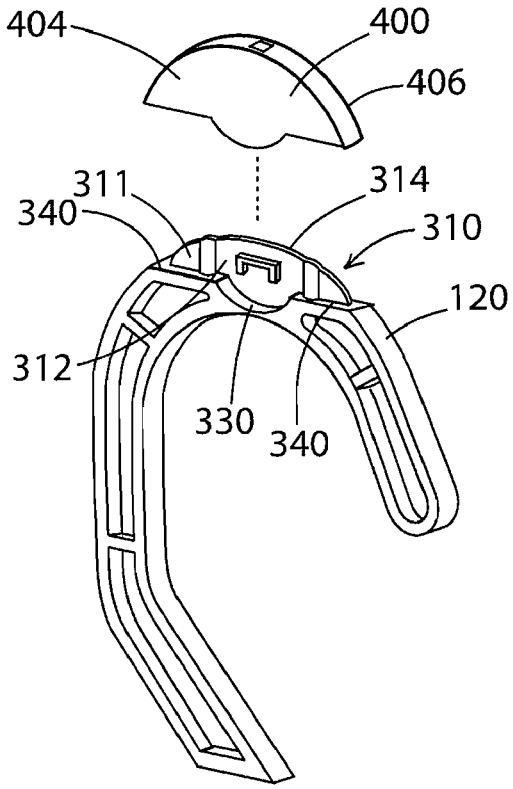
Fig. 6
Fig. 7
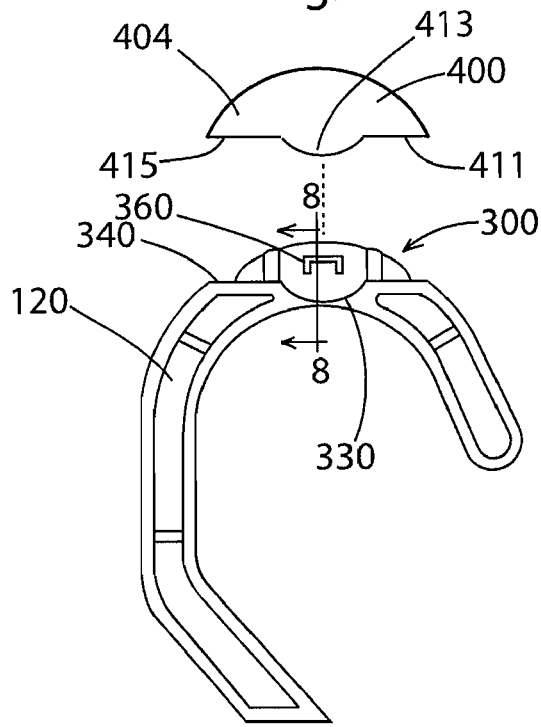
Fig. 8
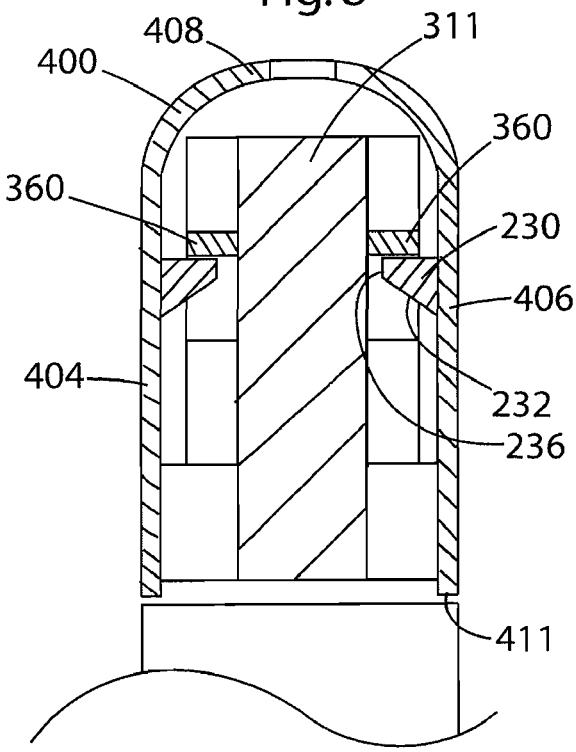

INDICATOR AND GARMENT HANGER

TECHNICAL FIELD

The present invention relates to a garment hanger of the type which includes a locking information clip and more particularly, to a top sizer clip for use with a garment hanger and one which is adapted to fit on most hangers/hook members.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of construction to accommodate different articles which are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

One accessory that is often used with a hanger is a size indicator that typically is a small plastic part that attaches to the body of the hanger and has indicia formed thereon that indicates the size or some other identifying mark of the article of clothing that is being held on the hanger. The size indicator can either take the form of a side sizer, where the clip (sizer) attached to the side of a hook member or a top sizer, where the clip attaches more to the top of the hook member.

Conventional top sizer clips are most times custom designed for a specific type or style of hanger (i.e., a matching hanger) and therefore, when they are used with other hangers, the clips tend not to be secured to the hanger but instead either are too small so that they can not be received on the base structure or they are too large and therefore, they wobble on the base structure and can easily become disengaged and fall off the hanger. By not having a secure attachment between the clip and the hanger, the size indicators do not perform their full intended function and instead can easily become misplaced and replacement thereof can result in the wrong size indicator being placed on the hanger which in turn can result in the wrong article of clothing being selected by a consumer or if no size indicator is present, the consumer may rummage through the clothing and leave an untidy display in order to find the proper size.

SUMMARY

In one aspect of the present invention, a top sizer is provided for use in combination with a garment hanger having a body and a hook member. The top sizer has a hollow body having an open bottom, a pair of side walls and a convex top wall that extends between the side walls and closes off a top of the top sizer and at least one locking member formed along an inner surface of one side wall.

In another aspect of the present invention, a combination garment hanger and a top sizer is provided. The hanger has a body and a hook member and the top sizer includes a hollow body having an open bottom, a pair of side walls and a convex top wall that extends between the side walls and closes off a top of the top sizer and at least one first locking member formed along an inner surface of one side wall. The hook member has a top portion that includes a second locking member and a ledge section surrounding the locking member. In a locked position, the first locking member of the top sizer body interlockingly engages the second locking member and a bottom edge of the hollow body is disposed proximate the ledge.

Other features and advantages of the present invention will be apparent from the following detailed description when read in conjunction with the accompanying drawings.

BRIEF DESCRIPTION OF THE DRAWING FIGURES

The foregoing and other features of the present invention will be more readily apparent from the following detailed description and drawings figures of illustrative embodiments of the invention in which:

FIG. 1 is a side perspective view of a garment hanger indicator according to one embodiment of the present invention and exploded from a garment hanger;

FIG. 2 is a side elevation view of the indicator and garment hanger;

FIG. 3 is a top plan view of a hook portion of the hanger;

FIG. 4 is a bottom plan view of the hanger indicator;

FIG. 6 is an exploded perspective view of a garment hanger indicator according to a second embodiment and hanger;

FIG. 7 is a side elevation view of the indicator and garment hanger; and

FIG. 8 is a cross-sectional view of the hanger indicator attached to the hanger.

DETAILED DESCRIPTION OF PREFERRED EMBODIMENTS

Figure 5:
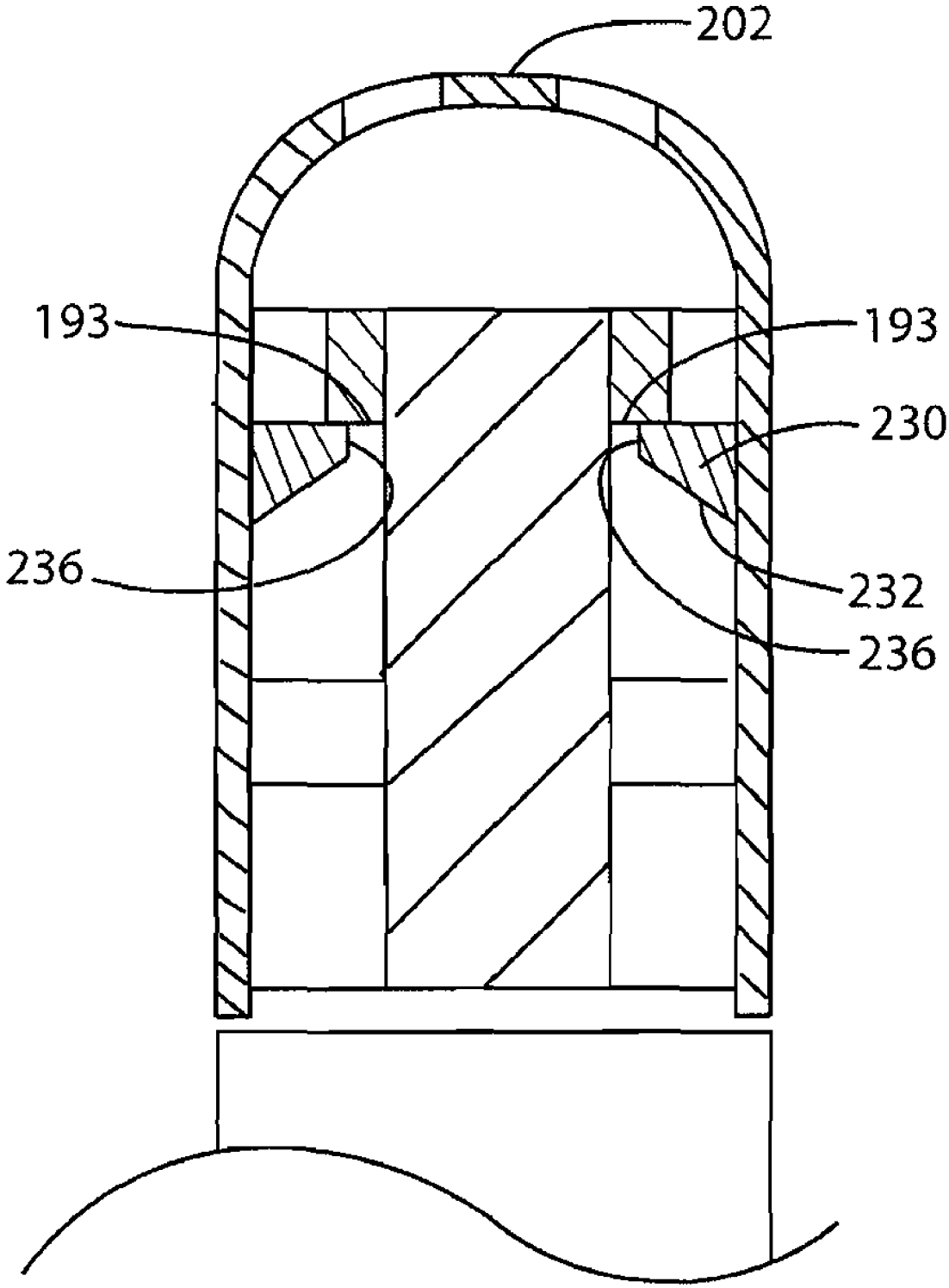
FIG. 5 is a cross-sectional view of the hanger indicator attached to the hanger.

FIG. 1 is a side elevation view of a garment hanger 100 that includes a body portion (cross bar) (not shown) having two opposing ends and a hook member 120 that is attached to the body portion 110. As described below, the garment hanger 100 is configured to receive and be releasably coupled to a top sizer (indicator or crown sizer) 200.

The hook member 120 has a top portion 130 including a support and locking component 140. The top portion 130 is a generally curved portion defined by a convex outer surface 132. The support and locking component 140 of the top portion 130 has a thickness that is less than the thickness of the other sections of the top portion 130 surrounding the support and locking component 140. The reduced thickness results in a platform or ledge 150 being formed around the support and locking component 140. The platform 150 is a generally planar platform that is generally rectangular in shape.

The platform 150 is formed so that it includes a pair of recessed sections 160. As shown in FIG. 1, the recessed sections 160 are centrally located and formed on opposite sides of the top portion 130. The recessed sections 160 are in the form of concave sections (e.g., crescent or U-shaped) that are defined by an arcuate surface 162. As a result of the central location of the arcuate surface 162, the recessed section 160 partitions the planar platform 150 into two portions, with one end of the arcuate surface 162 transitioning to one platform section 150 and the other end of the arcuate surface 162 transitioning to the other platform section 150. The recessed section 160 extends down toward the smooth lower surface 121 of the hook member 120.

The support and locking component 140 includes a means 180 for releasably locking the indicator 200 to the hanger 100. More specifically, each side of the support and locking component 140 of the hook member 120 includes a locking notch or channel 190 that is formed at one end along smooth outer surface 132 and is defined by a pair of spaced vertical walls 192. The channel 190 is thus a vertical channel that is formed along each side of the hook member 120. The channel 190 is oriented relative to the recessed section 160 so that the channel 190 is axially aligned with the recessed section 160 and in particular, it preferably is axially aligned with the middle of the recessed section 160. The notch 190 can be rectangular or square shaped and it formed an entrance into the space (channel) formed between the two vertical walls 192.

As shown in the figures, the two means 180 are axially aligned and formed in the same locations on opposite sides of the hook member 120. This is shown in the top plan view of FIG. 3.

The hanger 100 and hook member 120 are typically formed of a plastic material.

The indicator (top sizer) 200 is a hollow body that is defined by a top wall 202 and opposing first and second side walls 204, 206 that define a hollow interior compartment or cavity 207. In the illustrated embodiment, the top sizer 200 is generally arcuate shaped and in particular, the body can have a crescent shape. The body has an inner surface 208 that is formed within the interior compartment 207 and an outer surface 210.

The top wall 202 extends between the first and second side walls 204, 206 to close off the top of the indicator body. Since the indicator 200 has a curved construction, the top wall 202 resembles a convex ramp-like structure that extends upwardly from each end of the indicator 200 to the middle potion of the indicator which represents the highest point of the indicator 200.

The top wall 202 can be flat in construction; however, as shown, the top wall 202 can be a rounded wall that is formed between the first and second side walls 204, 206. In other words, there are rounded edges between the top wall 202 and each of the first and second side walls 204, 206.

Each of the side walls 204, 206 has a lower edge 220 that includes a pair of planar sections 222 that lie in one plane and a curved section 224 that lies below the planar sections 222. The curved section 224 has a convex shape and it extends downwardly from the planar sections 222. One end of the curved section 224 transitions into and is joined to one planar section 222 and the other end of the curved section 224 transitions into and is joined to the other planar section 224. Once again, the curved section 224 is preferably centrally located along the respective side wall 204, 206. The curved section 224 is thus a convex-shaped member that protrudes downwardly beyond the planar section 224 of the lower edge 220.

The dimensions and shape of the curved sections 224 are complementary to the recessed sections 160 since, as described below, the curved sections 224 are received in the recessed sections 160 when the indicator 200 is securely fastened to the hanger hook 120. Each side wall 204, 206 includes an area 205 for indicia to be placed and in the illustrated embodiment, the area 205 is a middle portion of the side wall 204, 206 and extends into the curved section 224. The indicia typically includes sizing information (e.g., "M" symbol for medium size).

The indicator 200 also includes a locking or engagement means 230 for securely attaching and coupling the indicator 200 to the support and locking component 140 of the hook member 120. The engagement means 230 is in the form of a pair of locking tabs 230 that engage and interlock with the channels 190 and in particular, the tabs 230 are vertically oriented within the inner cavity (compartment) of the indicator 200.

As shown in FIG. 5, each tab 230 has a first section 232 in the form of a ramp that acts as a cam surface. The first section 232 is closest to the bottom edge of the indicator body and is inclined inwardly toward the inner hollow cavity of the indicator 200 toward the other side wall. The ramp 232 terminates at a right angle edge 236 that represents the innermost portion of the tab 230. Alternatively, the ramp 232 leads to a vertical land 234 that terminates at the right angle edge 236 that represents the innermost portion of the tab 230. When the indicator 200 is in the locked upright position, as shown in FIG. 5, the vertical lands are parallel with one another.

In order to lock the indicator 200 relative to the hanger 100, the tabs 230 are first received into the notches 190 and then as the indicator 200 is moved down relative to the hanger 100, the tabs 230 are received first into the notches 190 and then travel into the locking channels (vertical spaces) formed between the vertical walls 192. More specifically, the inclined ramp 232 contacts the notch 190 of the support and locking component 140 of the hook member 120 and further downward movement of the indicator 200 causes the support and locking component 140 to ride along the ramp 232, thereby causing the side walls 204, 206 of the indicator 200 to bow outwardly to permit accommodation of the indicator 200 on the support and locking component 140.

The notch 190 is defined by an underside shoulder 193 that is located between the vertical walls 192. This shoulder 193 is a right angle shoulder and as illustrated, can be perpendicular to the vertical walls 192. The shoulder 193 can engage and lock relative to the right angle edge 236 of the tab 230 for securely holding the indicator 200 on the hanger 100 once the ramp 232 of the indicator tab 230 clear the shoulder 193.

When the indicator 200 lockingly engages the support and locking component 140 of the hanger 100, a clicking sound is heard to alert the user that the indicator 200 has been properly attached to the hanger 100. In addition, as illustrated, in the locked position, the lower edge 220 of the indicator abuts against the two platform sections 150 and the curved section 224 of the indicator 200 is received within the recessed section 160 since the two are complementary to one another.

In order to disengage the indicator 200 from the hanger 100 once the indicator 200 is securely attached to the support and locking component 140, the user simply inserts a finger nail under one side 204, 206 of the indicator 200 and applies an outward force causing the tab 230 to disengage wall 193.

If the indicator 200 is not properly aligned relative to the locking means 190, the tabs 230 will engage the wider curved (convex) surface 132 and will be prevented from moving further downward relative to the hook 120.

The exemplary garment hanger is of the type that can include a clamp or grip assembly formed near or at each of the first and second ends. The grip assemblies are integrally formed with body portion at the first and second ends. The article of clothing can be placed within the grip assembly. It will be appreciated that the top sizer indicator 100 can be formed of either an opaque material or transparent material, etc.

The body portion of the hanger, including any grip assemblies, is preferably made as a single piece, molded in plastic using a plastic injection molding machine, as understood by those skilled in the art. Any appropriate plastic can be used, such as styrene, which provides a clear, virtually transparent hanger and alternatively, the hanger can be molded using polypropylene, such as H.I. styrene polypropylene, polypropylene, polyvinylchloride, ABS or other suitable thermoplastics and/or mixtures thereof. As understood by those skilled in the art, the plastic mixture used to mold the hangers can include additional resins for added strength and reinforcement.

While the indicator (top sizer) 200 can be formed of any number of different materials, the indicator 200 is typically made from a plastic material using conventional techniques, such as molding techniques, e.g., injection molding. The indicator 200 can be either opaque in nature or semi-transparent or transparent and can be formed to have any number of different colors.

Referring now to FIGS. 6-8, an indicator/garment hanger combination according to another embodiment is illustrated. In particular, the hook member 120 of the hanger has a different support and locking component 300 than the previous embodiment; however, the component 300 shares some similarity to the component 140. The hook member 120 is curved shape, with a top portion 310 thereof being modified and being thinner than a surrounding portion and therefore, a planar peripheral ledge 320 is formed around the top portion 310 that is constructed to lockingly engage the indicator 400. More specifically, the top portion 310 includes an upright vertical wall 311 that has a first face 312 and an opposing second face 314.

The peripheral ledge 320 extends around the vertical wall 311 and has a concave portion 330 that is located in a middle section of the ledge 320 in that the concave portion 330 partitions the ledge 320 into first and second planar portions 340.

The vertical wall 311 is formed and positioned so that it is axially aligned with the concave portion 330. The vertical wall 311 has a complementary shape compared to the indicator 400 and in the illustrated embodiment, the vertical wall 311 is arcuate in shape and in particular, has a crescent shape.

Each of the first face 312 and the second face 314 includes an interlocking member 360 that serves to releasably interlock the indicator 400 to the support and locking component 300. In the illustrated embodiment, the interlocking member 360 is in the form of an inverted C- shaped or U-shaped protrusion or tab. The tab 360 is centrally located in that it is located in a middle portion of the vertical wall 311 and it is also located in a middle portion of the concave portion 330.

Similar to the first embodiment, the indicator 400 can be similar or identical to the indicator of the first embodiment. The indicator 400 thus is a generally hollow member that has a body that is defined by two side walls 404, 406 and a convex, arcuate upper wall 408 that extends between the two side walls 404, 406. A bottom edge 411 of each of the side walls 404, 406 is not a planar edge but instead, the bottom edge 411 includes a convex portion 413 that is centrally located along the bottom edge 411 such that is partitions the bottom edge 411 into two planar sections 415 on either side of the convex portion 413. The bottom edge 411 of the indicator 400 thus has a shape that is complementary to the shape of the first and second planar portions 340 and concave portion 330.

In order to lock the indicator 400 to the support and locking component 300, the indicator 400 is inverted with the bottom edge 411 facing down and the locking tabs 230 are aligned with the interlocking member 360 (the inverted C- shaped or U-shaped protrusion or tab 370). The locking tabs 230 are formed within the interior compartment of the indicator 400 and in particular, the locking tabs 230 are formed along the inner surfaces of the side walls. Each tab 230 has a first section 232 in the form of a ramp that acts as a cam surface. The first section 232 is closest to the bottom edge of the indicator body and is inclined inwardly toward the inner hollow cavity of the indicator 200 toward the other side wall. The ramp 232 terminates at a right angle edge 236 that represents the innermost portion of the tab 230.

As tabs 230 of the indicator 400 initially engage the locking tabs 370, the ramps 232 of the tabs 230 initially contact center rails of the opposing tabs 370. As the indicator 400 is continuously driven downward toward the hook member, the ramps 232 ride along the center rails until the edges 236 clear the center rails and enter the space formed between the two opposingly spaced end edges of the tab 370. FIG. 8 shows the indicator 400 mated with the hanger's locking component 300. When the edges 236 clear the center rails, the indicator 400 snap-lockingly mates with the locking component 300 and an audible click can be heard. The planar surfaces of the bottom edge of the indicator 400 and the convex portion of the indicator 400 mate with the complementary planar surfaces of the ledge and the concave portion, respectively, when the indicator is in the locked position.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. In combination with a garment hanger having a body and a hook member, a top sizer comprising:

a hollow body having an open bottom, a pair of side walls and a convex top wall that extends between the side walls and at least one first locking member formed along an inner surface of one side wall, and wherein the hook member has a top portion that includes a second locking member and a ledge section surrounding the second locking member, wherein in a locked position, the first locking member of the top sizer body interlockingly engages the second locking member and a bottom edge of the hollow body is disposed proximate the ledge, wherein the top portion of the hook member has a convex section that has a pair of notches formed therein on opposite sides of the convex section across from one another, wherein each notch is open along a topmost surface of the convex section of the top portion and forms an entrance into a locking channel that receives the first locking member and is defined in part by a locking edge that engages the first locking member to lock the indicator in the locked position, wherein the entrance is defined by a pair of opposing, parallel vertical ribs, the locking edge being formed between the vertical ribs.

2. In combination with a garment hanger having a body and a hook member, a top sizer comprising:

a hollow body having an open bottom, a pair of side walls and a convex top wall that extends between the side walls and at least one first locking member formed along an inner surface of one side wall, and wherein the hook member has a top portion that includes a second locking member and a ledge section surrounding the second locking member, wherein in a locked position, the first locking member of the top sizer body interlockingly engages the second locking member and a bottom edge of the hollow body is disposed proximate the ledge, wherein the ledge section is formed along opposing sides of the hook member, each ledge section along each side including a recessed concave section that receives a convex portion of the indicator when the indicator is in the locked position.

3. The combination of claim 2, wherein the recessed concave section partitions the ledge section into two planar ledge sections and planar sections of the bottom edge of the indicator on each side of the convex portion are disposed adjacent the two planar ledge sections.

4. The combination of claim 2, wherein each locking member comprises a locking tab having a beveled cam surface that terminates at a locking edge.

5. The combination of claim 4, wherein the locking edge is formed at a right angle to the beveled cam surface.

6. The combination of claim 5, wherein the top portion of the hook member has a convex section that has a pair of notches formed therein on opposite sides of the convex section, wherein the notch forms an entrance into a locking channel that receives the locking tab and is defined in part by a locking edge that engages the locking edge to lock the indicator in the locked position.

7. The combination of claim 6, wherein notch and entrance are axially aligned with a recessed concave section that is part of the ledge and that receives the convex portion of the indicator when the indicator is in the locked position.

8. The combination of claim 2, wherein the ledge extends around a periphery of the second locking member.

* * * * *